United States Patent [19]

Sherk

[11] 4,071,287

[45] Jan. 31, 1978

[54] MANUFACTURING PROCESS FOR GASEOUS DISCHARGE DEVICE

[75] Inventor: Thomas Albert Sherk, West Hurley, N.Y.

[73] Assignee: International Business Machines Corporation, Armonk, N.Y.

[21] Appl. No.: 666,999

[22] Filed: Mar. 15, 1976

[51] Int. Cl.[2] ..... H01J 9/18

[52] U.S. Cl. ..... 316/19; 316/20

[58] Field of Search ..... 316/19, 20; 29/25.13, 29/25.16

[56] References Cited

U.S. PATENT DOCUMENTS

| | | | |
|---|---|---|---|
| 3,225,132 | 12/1965 | Baas et al. | 174/151 |
| 3,778,126 | 12/1973 | Wilson | 316/20 |
| 3,778,127 | 12/1973 | Langston, Jr. et al. | 316/20 |
| 3,837,724 | 9/1974 | Haberland et al. | 316/20 |
| 3,862,830 | 1/1975 | Stern | 65/58 |
| 3,973,815 | 8/1976 | Bode et al. | 316/20 |
| 3,975,176 | 8/1976 | Salisbury | 65/38 |

*Primary Examiner*—Richard B. Lazarus

*Attorney, Agent, or Firm*—Joseph J. Connerton; John F. Hanifin; Julius Jancin, Jr.

[57] ABSTRACT

A method is disclosed for the fabrication of a gaseous discharge display and/or memory device which provides a predetermined uniform gap between the inner walls of the gaseous discharge device without the use of spacer elements. Sealing about the panel periphery is provided by a devitrifiable seal glass, the viscosity of which is closely controlled as a function of time and temperature. The glass sealant, preferably in rod form, is extruded by mixing glass frit with a solvent-binder system to form a viscous slurry, extruding this slurry into rod form and thereafter sintering the rods in an oven under conditions whereby the glass sealant softens but does not reflow. The devitrifiable glass during the subsequent sealing process reflows and then crystallizes, and the viscous flow varies inversely as the crystallization. By careful control of the time, temperature, pressure composition and configuration of the devitrifiable sealing glass, the amount of flow of the sealing glass is controlled, and a pedetermined and uniform chamber gap is provided. The subject invention represents an improvement in the assembly of gaseous discharge devices by eliminating the requirement for spacer elements.

5 Claims, 4 Drawing Figures

MANUFACTURING PROCESS FOR GASEOUS DISCHARGE DEVICE

BACKGROUND OF THE INVENTION

In fabrication of conventional gaseous discharge panel assemblies, conductor arrays of parallel lines are formed on a pair of glass plates, a protective coating of dielectric formed over the conductors, the plates positioned with their lines orthogonal to each other, a glass sealant placed between the glass plates around the periphery of the panel and the resultant assembly placed in an oven whereby reflow of the glass sealing material provides a seal between the respective plates of the assembly to form a gaseous chamber. One of the critical parameters of this assembly is the chamber discharge gap, i.e., the distance between the opposing dielectric walls. Conventionally discrete spacer members are utilized to provide and maintain this gap. An example of gas panel fabrication is shown in U.S. Pat. No. 3,837,724—"Gas Panel Fabrication" filed by Peter H. Haberland et al., Oct. 10, 1973. In the sealing operation, the seal material is mixed with an organic binder and a bakeout operation is used to remove impurities prior to the sealing cycle. Such conventional sealing glass generally takes the form of a vitreous solder glass mixed with a binder such as nitro-cellulose which when reflowed causes the plates to come together until stopped by the spacer members to thereby provide a uniform gap between the panel plates. Alternatively, a preformed sealing rod of vitreous glass may be employed. A method of sealing the plates of a gas panel using soft glass sealing material and hard glass spacers both in rod form is shown in U.S. Pat. No. 3,778,127—"Sealing Technique for Gas Panel" filed by P. R. Langston et al., Dec. 30, 1971. Problems associated with this type of gas panel fabrication and spacers in general include fragility, the effect within the panel of breakage or fracture during fabrication, panel contamination from surface debris adhering to the spacer rods, unwanted light reflection, and additional cost of both material and labor.

SUMMARY OF THE INVENTION

In accordance with the instant invention, an improved method is disclosed for fabricating a gas panel and obtaining a uniform and predetermined discharge gap between the opposing plates of the panel without the use of discrete spacer elements. Conventional vitreous glass sealants do not crystallize and the viscosity varies with the temperature whereby the glass sealants become soft and flows as the viscosity decreases with increasing temperature. Devitrifiable sealing glasses, on the other hand, are characterized by crystallinity, i.e., the formation of crystals at elevated temperatures which tend to retard the viscous flow of the glass sealant. As the temperature rises, the viscosity decreases until it reaches a temperature at which it starts to crystallize, about 450° C in the preferred embodiment. By maintaining the devitrifiable sealant at this temperature, the viscosity and crystallization increase to a stabilized point thereby further retarding the viscous flow of the sealant. The devitrifiable glass sealant may be in frit form or extruded into rod form by mixing with an organic binder such as an amyl-acetate and nitro-cellulose solution and then sintered, i.e., heated to the vicinity of the softening point of the sealant but substantially below the reflow temperature of the sealant glass. As the sealing rod is sintered, the sintering process causes the frit particles to wet together, thereby forming a rod preform which can be handled mechanically. During subsequent heating to a higher reflow temperature, the sintered rod reflows and then crystallizes. The crystallization of the sealing glass causes the viscosity of the glass to increase, thereby limiting viscous flow. By limiting the viscous flow, coupled with appropriate control of the time, temperature, and physical configuration of the devitrifiable sealing glass, a predetermined chamber space is obtained without intermediate spacer members. The preferred configuration of the sealant rods comprises a flat bottom and a convex top for ease of handling and positioning during the fabrication process. This configuration also lends itself to the extrusion process described in greater detail hereinafter. By means of the above method, the chamber spacing is defined by the sealant and a saving is provided in processing and assembly time and fabrication complexity by eliminating the requirement for discrete spacers.

Accordingly, a primary object of the present invention is to provide an improved method of fabricating a gaseous discharge display device.

Another object of the present invention is to provide an improved fabrication technique for the production of gas panels wherein a uniform discharge gap is provided between the plates of the panels without the use of discrete spacer elements.

Another object of the instant invention is directed to a method of extruding devitrifiable seal glass frit into rod form for use in gas panel fabrication.

The foregoing and other objects, features and advantages of the invention will be apparent from the following more particular description of a preferred embodiment of the invention as illustrated in the accompanying drawings.

DESCRIPTION OF PREFERRED EMBODIMENT

Figure 1:
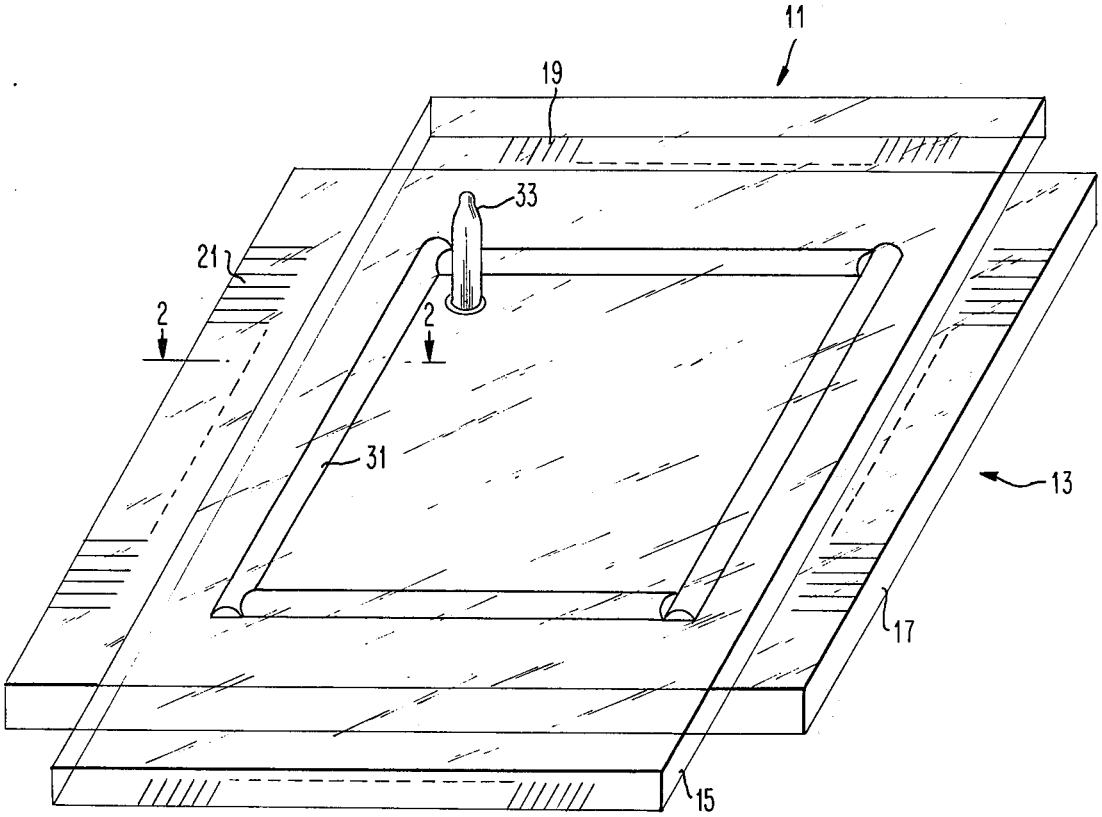
FIG. 1 is a schematic perspective view of a gaseous discharge display device embodying the invention.
Figure 2:
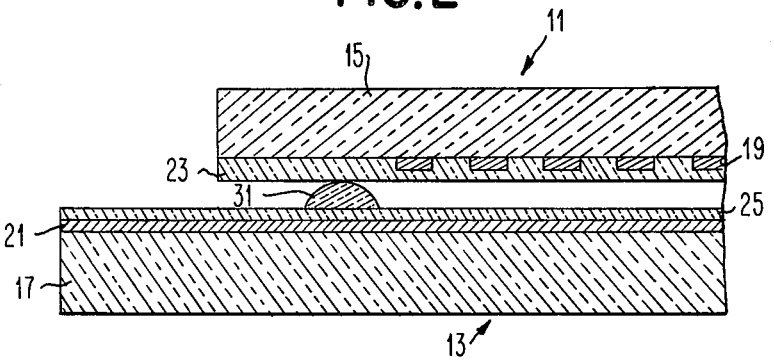
FIG. 2 is a fragmentary sectional view taken along the lines 2—2 of FIG. 1 showing details of a preferred embodiment of the invention prior to devitrification of the sealant glass.

Referring now to the drawings and more particularly to FIG. 1 thereof, the gaseous discharge display and/or memory device comprises an upper plate 11 and a lower plate 13, each plate including substrate members 15 and 17 respectively. On the facing inner surfaces of substrates 15 and 17 are formed conductor arrays 19 and 21 respectively, each array comprising a plurality of parallel conductors with the arrays disposed orthogonal relative to each other. The conductors extend to the plate edge extensions of their respective substrates for connection to a driving source, not shown, and the conductor arrays within the viewing surface of the panel are overlaid with transparent dielectric coatings 23 and 25 as shown in FIG. 2.

Plates 11 and 13 are sealed to form a gas containing envelope in the following manner. Glass sealant material preferably in the form of rods 31 of devitrifying sealing glass are placed in a border-like pattern about the outer edge of the viewing surface of the panel. These rods in the preferred embodiment have a flat bottom and generally convex upper configuration, the flat surface facilitating positioning and handling the rods during the sealing operation. However, it will be appreciated that various rod configurations may be employed, the primary consideration relating to cross-sectional areas as described more fully hereinafter.

While the sealant member 31 could comprise a devitrifying solder glass in frit form which has been mixed with a conventional organic binder and thereafter sintered in the oven, it is preferably extruded in rod form. In extruding devitrifying sealing glass, sealing glass frit is mixed in slurry form with an amyl-acetate and nitro-cellulose solution. The slurry is then extruded into rod form onto a flat mylar coated substrate using conventional extrusion tools. The mylar coating is used to avoid wetting of the rod to the substrate, since it fuses during sintering if in intimate contact with any conductive or non-conductive substrate. The extruded rods are then air dried for 24 hours to evaporate the amyl-acetate vehicle and harden the nitro-cellulose to provide sufficient strength for handling and transfer purposes. The extruded rods are then inverted onto an alumina setter tile and the mylar film peeled away. The rods are then exposed to a sintering process wherein the nitro-cellulose is pyrolized, resulting in a rod of excellent mechanical strength. The sintering operation, which may consist of an oven cycle of approximately 370° Centigrade for a period of 5–10 minutes, is relatively critical and must be performed in a closely controlled environment such that the prescribed temperature is uniformly maintained for the prescribed time. If the sintering temperature is too high or the time too long, excessive nucleation occurs which increases the rate at which crystallization occurs and thereby retards the viscous flow of the glass sealant. If the temperature is too low or the time too short, surface glaze of the rod is incomplete and particles come off the rod during subsequent processing. It should be noted that by utilizing sintered rods in the fabrication process rather than glass frit with a binder, the impurities from the seal and associated binder in conventional seals are eliminated, a significant advantage in high quality control processes necessary for gaseous discharge display device fabrication.

Before describing the fabrication, the devitrifying sealing glass utilized in the instant invention must have certain characteristics. The gas panel fabrication process provides a refractory coating of magnesium oxide over the dielectric which crazes at a temperature about 480° C. Accordingly, the glass sealant must have a sufficiently low softening point to seal below this temperature, preferably about 450° C. In addition, it must be compatible in thermal expansion characteristics with the float glass substrate, which comprises in a preferred embodiment conventional soda-lime-silica glass. Finally, the seal glass must have a fairly broad vitreous range so that adequate flow can be obtained prior to crystallization. Glasses having these characteristics are known in the art and commercially available.

When the sealant rods are positioned in the general manner illustrated in FIG. 1, the assembly is placed in an oven and heated in the manner described in the aforenoted referenced Haberland et al. U.S. Pat. No. 3,837,724 to the seal temperature or flow point of the sealant, 450° C. Pressure is applied to the plates to be sealed through conventional means such as weight of 2500 grams positioned atop the upper plate 11. As the assembly is held at the flow point temperature, the devitrifying sealing glass crystallizes, and the formation of crystals continues until the sealant reaches a maximum level of about 70% crystallinity. The crystallization is significant since it is required to match the thermal expansion characteristics of the sealant with those of the substrate glasses and at the same time retard viscous flow. The temperature must be maintained below the point at which the crystal starts to dissolve in the glass, since reflow of the seal glass would result and cause the plates to come together. Assuming that all parameters have been maintained substantially uniform as described above, the discharge gap will be controlled as a function of the cross sectional area of the sealant material in a manner more fully described hereinafter. Since no further deformation of the sealant rod takes place after it reaches its maximum crystallization, time is not a critical limitation to this aspect of the invention.

Figure 3:
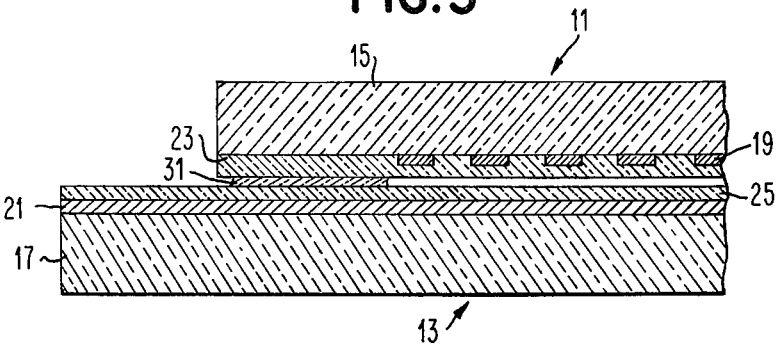
FIG. 3 is a time displaced fragmentary sectional view taken along the lines 2—2 of FIG. 1 showing details of a preferred embodiment of the invention after the divitrification of the glass sealant.

FIGS. 2 and 3 are sectional views taken along the lines 2—2 of FIG. 1, but differ chronologically. While these drawings are not to scale, they are intended to depict the relative structure of a portion of the assembly before and after sealing. Referring first to FIG. 2, the sealant rod is indicated prior to reflow. Initially, the rod is substantially higher than the discharge gap, and in the preferred embodiment is 16 mils high vs 100 mils on the bottom portion. After reflow, as indicated in FIG. 3, the reflowed sealant rod 31 and therefore the discharge gap is 4 mils high and approximately 300 mils wide. After the assembly has been completely processed as above described, it is evacuated via exhaust tube 33 and then charged with an illuminable gas at appropriate pressure whereupon the exhaust tube is tipped off to permanently entrap the gas within the chamber.

Figure 4:
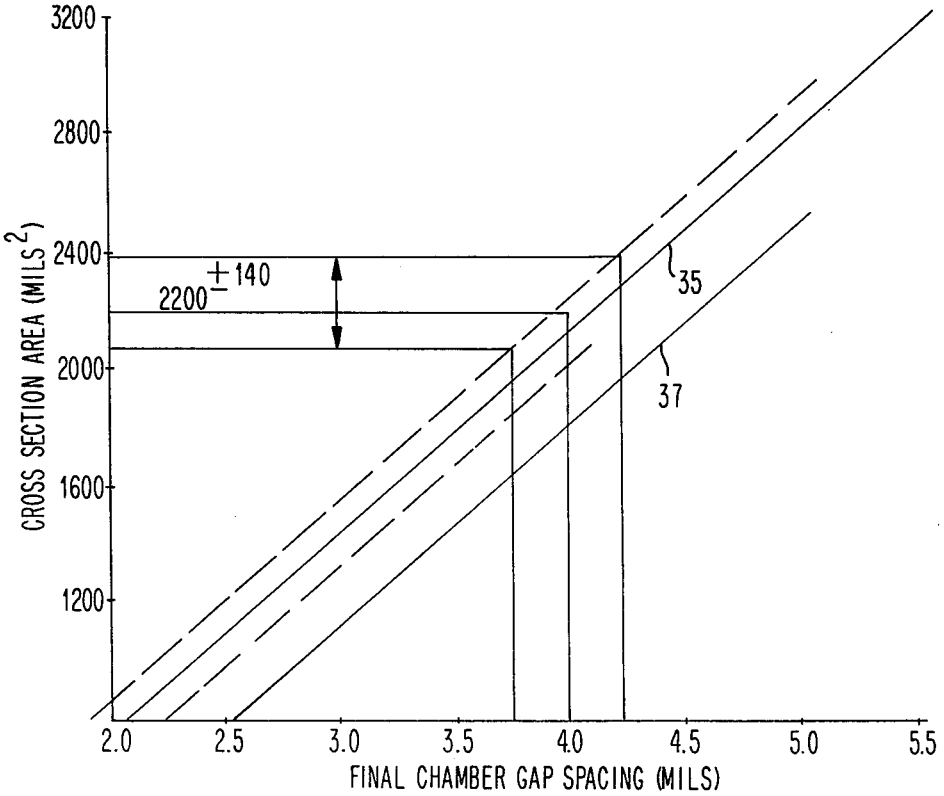
FIG. 4 is a graph of chamber gap vs the cross sectional area of the glass sealant member.

Referring briefly to FIG. 4, the graphs illustrate the relationship between a desired discharge gap and the corresponding cross-sectional area of devitrifying sealant glass necessary to provide this gap either under the parameters defined in this application, or those in the aforereferenced Haberland et al. U.S. Pat. No. 3,837,724. The abscissa designates the chamber gap in terms of mils, while the ordinate defines the cross-sectional area of the sealant in terms of square mils. The variations for two forms of sealant are illustrated in the drawing, curve 35 for devitrified glass sealant in frit form, curve 37 for the sealant in sintered rod form. Allowable tolerances for discharge gap are generally $\pm 0.2$ mils, and the corresponding curves for these values illustrates the necessary cross-sectional area to achieve the desired gap. For example, a 4 $\pm 0.2$ mil gap requires a cross-sectional area of glass frit of 2200 $\pm$ 140 square mil cross-sectional area. Since chamber gap is only one of many variable parameters in a gas panel display, it is subject to change, and the appropriate cross-sectional area of sealant material either in frit or rod form for any discharge gap may be readily determined from the curves in FIG. 4.

While the invention has been shown and described with reference to preferred embodiments thereof, it will be appreciated that various changes in form and detail may be made by those skilled in the art without departing from the spirit and scope of the invention. Accordingly, the gas discharge display/memory device herein disclosed and the method of making same are to be considered as merely illustrative and the scope of the invention is to be limited only as specified in the claims.

I claim:

1. A method of fabricating a gaseous discharge display device without discrete spacers comprising the steps of providing first and second glass plates, each of said glass plates having arrays of parallel lines overcoated with a dielectric material, positioning preforms of devitrifiable glass sealant on one of said members in a frame-like border defining the display area of said first and second plates, placing said second glass plate on said first glass plate to form an assembly wherein the parallel conductor array of said second glass plate extends orthogonally to the parallel conductor array of said first glass plate, heating said assembly to a controlled temperature above the flow point of said glass sealant preform within a range of 440° – 480° C. for a predetermined time interval whereby said sealant preform deforms, crystallizes and fuses to said plates as it progresses from a viscous to a crystalline state to seal said plates spaced apart a predetermined distance corresponding to the discharge gap between said plates, placing said upper plate under tension to assist said preformed glass sealant deformation in providing a uniform discharge gap between said plates, the boundaries of which are controlled solely as a function of the temperature and time parameters of said heating step and the composition and cross-dimensional area of said glass sealant preform, and, evacuating and backfilling said chamber with an illuminable gas under a defined pressure.

2. A method of fabricating a gas panel having a predetermined discharge gap between the plates of said panel without the use of spacer technology, comprising the steps of:

1. providing first and second substantially transparent glass plates,
2. forming parallel conductor arrays on each of said glass plates,
3. overcoating said conductor arrays with a layer of dielectric,
4. mixing a slurry of devitrified glass frit with a solution of organic binder and solvent to form a slurry containing particles of devitrified glass frit,
5. extruding said slurry into a preformed rod configuration,
6. sintering said preformed rods into devitrified glass form within controlled time and temperature parameters,
7. placing said preformed devitrified glass rods in a frame-like border about the display area and over the dielectric surface of said first plate,
8. forming a gas panel assembly by placing said second plate on said first plate with the parallel lines of said second plate extending orthogonally to the parallel lines of said first plate,
9. heating said assembly of said first and second plates at a controlled temperature above the flow point of said preformed rod members within a range of 440° – 480° C. for a predetermined time interval causing said preformed rod members to deform, crystallize and fuse to said plates to seal said plates spaced apart a predetermined distance to thereby form a chamber wherein said distance corresponds to said predetermined discharge gap, said distance being controlled solely as a function of said temperature and time parameters of said heating step,
10. evacuating said chamber through the gas panel tubulation member and thereafter backfilling said chamber with an illuminable gas, and
11. tipping off said tubulation member thereby sealing said illuminable gas in said chamber under a defined pressure.

3. A method of the type claimed in claim 2 wherein said preformed rods are sintered at a temperature of 370° C for a time interval of 5–10 minutes.

4. A method of the type claimed in claim 1 wherein a preferred temperature for heating said first and second plate assembly is 450° C.

5. A method of the type claimed in claim 1 wherein said preformed rod configuration is a flat bottom rod having a concave upper surface.

* * * * *